US012790938B2

(12) United States Patent
Alvarez et al.

(10) Patent No.: US 12,790,938 B2
(45) Date of Patent: Nov. 10, 2026

(54) CASING DEFORMATION MONITORING

(71) Applicant: Saudi Arabian Oil Company, Dhahran (SA)

(72) Inventors: Jose Oliverio Alvarez, Houston, TX (US); Damian Pablo San Roman Alerigi, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 536 days.

(21) Appl. No.: 17/930,896

(22) Filed: Sep. 9, 2022

(65) Prior Publication Data

US 2024/0084695 A1 Mar. 14, 2024

(51) Int. Cl.

| | |
|---|---|
| ***E21B 47/085*** | (2012.01) |
| ***E21B 47/005*** | (2012.01) |
| ***E21B 47/135*** | (2012.01) |
| ***E21B 47/16*** | (2006.01) |

(52) U.S. Cl.
CPC ..... *E21B 47/085* (2020.05); *E21B 47/135* (2020.05); *E21B 47/16* (2013.01); *E21B 47/005* (2020.05)

(58) Field of Classification Search
None
See application file for complete search history.

(56) References Cited

U.S. PATENT DOCUMENTS

| | | | | |
|---|---|---|---|---|
| 4,328,704 | A | 5/1982 | Arpasi et al. | |
| 6,252,656 | B1 * | 6/2001 | Wu | G08C 23/06 356/73.1 |
| 6,874,361 | B1 * | 4/2005 | Meltz | E21B 43/14 73/152.32 |
| 6,931,149 | B2 * | 8/2005 | Hagene | G01N 21/954 382/141 |

(Continued)

FOREIGN PATENT DOCUMENTS

| | | | |
|---|---|---|---|
| WO | WO 2013050791 | A1 | 4/2013 |
| WO | WO 2015054432 | A1 | 4/2015 |

OTHER PUBLICATIONS

Yang, Shangyu, et al. "Research on Accurate Detection Algorithm for the Cross-Section of Shale Gas Casing Deformation Pipe String Based on Laser Ranging." Processes 12.7 (2024). (Year: 2024).*

(Continued)

*Primary Examiner* — Jonathan D Armstrong
(74) *Attorney, Agent, or Firm* — Fish & Richardson P.C.

(57) ABSTRACT

A system for monitoring a casing within a well includes tubing with an outer surface, a housing having an inner wall, an outer wall, and two end walls extending between the inner wall and the outer wall to define an annular enclosure, the housing extending around at least a portion of the tubing with an outer surface of the inner wall in contact with the outer surface of the tubing, a cylinder including an elastomer, the cylinder extending outward from an outer surface of the outer wall of the housing, the cylinder sized to contact an inner surface of the casing during use, a plurality of (Continued)

optical distance sensors, associated electronics, and a battery positioned inside the housing, a plurality of light sources positioned within the housing, each light source operable to emit light towards an optical distance sensor, and a transmitter.

12 Claims, 5 Drawing Sheets

(56) References Cited

U.S. PATENT DOCUMENTS 7,006,918 B2 2/2006 Economides et al.
7,424,928 B2 * 9/2008 Cox ..... G01V 1/523 181/111
7,455,106 B2 * 11/2008 Veneruso ..... C08J 7/0427 166/243
7,760,335 B2 7/2010 Wolf et al.
7,773,454 B2 * 8/2010 Barolak ..... E21B 47/005 181/105
7,819,182 B2 10/2010 Adamek
7,832,477 B2 11/2010 Cavender et al.
7,950,456 B2 5/2011 Cavender et al.
9,574,434 B2 2/2017 Albrecht et al.
10,125,599 B2 * 11/2018 Goodwin ..... E21B 47/13
10,386,526 B2 8/2019 Wu et al.
10,655,460 B2 5/2020 Segura Dominguez
11,028,670 B2 * 6/2021 Cioanta ..... C09K 8/58
11,150,374 B2 10/2021 Capoglu et al.
11,852,005 B2 * 12/2023 San Roman Alerigi ..... E21B 47/01
2001/0050172 A1 * 12/2001 Tolman ..... E21B 43/27 166/305.1
2003/0221829 A1 * 12/2003 Patel ..... E21B 43/10 166/278
2004/0112595 A1 * 6/2004 Bostick, III ..... E21B 47/06 166/250.01
2005/0150713 A1 * 7/2005 Garcia-Osuna ..... G01V 1/44 181/111
2005/0152219 A1 * 7/2005 Garcia-Osuna ..... G01V 1/52 367/25
2006/0102343 A1 * 5/2006 Skinner ..... B23K 26/082 166/57
2007/0051510 A1 * 3/2007 Veneruso ..... C08J 7/0427 166/243
2007/0056794 A1 * 3/2007 Cox ..... G01V 1/523 181/111
2007/0206439 A1 * 9/2007 Barolak ..... E21B 47/005 367/35
2009/0183941 A1 * 7/2009 Pabon ..... G01V 1/523 181/102
2010/0258303 A1 * 10/2010 Alberty ..... E21B 47/08 175/48
2012/0312560 A1 * 12/2012 Bahr ..... E21B 33/1208 166/387
2013/0050791 A1 2/2013 Nakazono et al.
2013/0188168 A1 * 7/2013 Hartog ..... E21B 47/135 356/634
2013/0319984 A1 * 12/2013 Linyaev ..... B23K 26/106 219/121.72
2014/0182933 A1 * 7/2014 Skinner ..... B23K 26/082 175/16
2014/0336937 A1 * 11/2014 Hallundb ..... E21B 47/0025 702/8
2016/0170063 A1 * 6/2016 Leggett ..... G01S 7/52003 367/7
2016/0349403 A1 * 12/2016 Farhadiroushan ..... G01N 21/68
2017/0167249 A1 * 6/2017 Lee ..... E21B 43/128
2017/0241263 A1 * 8/2017 Heller ..... E03B 3/08
2018/0059248 A1 * 3/2018 O'Keeffe ..... G01S 17/42
2018/0100929 A1 * 4/2018 O'Keeffe ..... G01S 17/931
2018/0157155 A1 * 6/2018 Gryshchenko ..... G03B 21/2033
2019/0249528 A1 * 8/2019 Wright ..... E21B 43/2401
2019/0257187 A1 8/2019 Aljubran et al.
2021/0324729 A1 * 10/2021 Yogeswaren ..... G01N 29/2437
2023/0041700 A1 * 2/2023 Blois ..... G01S 7/4813
2023/0184086 A1 * 6/2023 San Roman Alerigi ..... E21B 47/01 166/250.01
2024/0061124 A1 * 2/2024 Blois ..... G01S 7/487

OTHER PUBLICATIONS

Mizunuma, Mamoru, Shigeki Ogawa, and Hiroki Kuwano. "Deformation detection on the pipe inner wall using a laser-beam scanning displacement sensor." Industrial Optical Sensing and Metrology: Applications and Integration. vol. 2066. SPIE, 1993. (Year: 1993).*
Boschtools.com [online], "Laser measures," 2016, retrieved on Jul. 15, 2021, retrieved from URL <https://www.boschtools.com/us/en/boschtools-ocs/laser-measures-23502-c/>, 5 pages.
Kavvadas, "Monitoring ground deformation in tunneling: Current practice in transportation tunnels," Engineering Geology, Jun. 2005, 79(1-2):93-113, 21 pages.
MTIInstruments.com [online], "Fotonic plug-in module," 2021, retrieved on Jul. 15, 2021, retrieved from URL <https://mtiinstruments.com/products/non-contact-measurement/fiber-optic-sensors/fotonic-plug-in-module/>, 7 pages.
SAIP Examination Report in Saudi Arabian Appln. No. 123450323, dated Mar. 21, 2025, 28 pages (with English translation).

* cited by examiner

CASING DEFORMATION MONITORING

TECHNICAL FIELD

This disclosure relates to monitoring of casing deformations in a well.

BACKGROUND

An oil well is a boring in the Earth that is designed to bring hydrocarbons to the surface. A well that is designed to produce only gas may be termed a gas well. Wells are created by drilling down into an oil or gas reserve that is then mounted with an extraction device, which allows extraction from the reserve.

Metal loss and deformations compromise the structural integrity of a well. Casing deformation may occur over periods of time ranging from months to weeks. Sustained casing pressure can cause casing deformation or failure, which can have safety consequences.

SUMMARY

Casing deformations compromise the structural integrity of a well and may occur over periods of time ranging from months to weeks. These systems and methods can reduce failures, microfractures, or cracks in well casings and other tubulars.

In an aspect, a system for monitoring a casing within a well includes tubing with an outer surface, a housing having an inner wall, an outer wall, and two end walls extending between the inner wall and the outer wall to define an annular enclosure, the housing extending around at least a portion of the tubing with an outer surface of the inner wall in contact with the outer surface of the tubing, a cylinder including an elastomer, the cylinder extending outward from an outer surface of the outer wall of the housing, the cylinder sized to contact an inner surface of the casing during use, a plurality of optical distance sensors, associated electronics, and a battery positioned inside the housing, each optical distance sensor including a laser operable to emit light towards an inner surface of the outer wall of the housing, and a transmitter.

Systems can include one or more of the following features.

In some implementations, the optical distance sensors are organized along the inner wall of the housing.

In some implementations, the associated electronics are configured to encode the time of arrival and incidence angle of an emitted light received at an optical distance sensor of the array of optical distance sensors into data and send the data via the transmitter to a computer.

In some implementations, the plurality of optical distance sensors includes four optical distance sensors distributed at 90 degrees of azimuthal separation.

In some implementations, the laser of each optical distance sensor is operable to emit light perpendicular to the inner surface of the outer wall of the housing.

In some implementations, a laser of one of the plurality of optical sensors is operable to emit light at an angle relative to the inner surface of the outer wall of the housing, and other optical distance sensors of the plurality of optical sensors measure an intensity and angle of incidence of the laser.

In some implementations, each laser of the plurality of optical distance sensors emit light simultaneously. In some cases, each emitted light has a distinct frequency.

In some implementations, the lasers are low power lasers.

In some implementations, the lasers are green or yellow lasers.

In some implementations, the transmitter includes an electric-acoustic transducer.

In an aspect, method for monitoring tubing within a well includes deploying a system in a well, the system having a housing having an inner wall, an outer wall, and two end walls extending between the inner wall and the outer wall to define an annular enclosure, the housing extending around at least a portion of the tubing with an outer surface of the inner wall in contact with the outer surface of the tubing, a cylinder including an elastomer, the cylinder extending outward from an outer surface of the outer wall of the housing, the cylinder sized to contact an inner surface of the casing during use, a plurality of optical distance sensors, associated electronics, and a battery positioned inside the housing, each optical distance sensor including at one laser operable to emit light towards an inner surface of the outer wall of the housing, and a transmitter, emitting light towards the inner surface of the outer wall of the housing, and measuring the time of arrival, incidence angle, and/or intensity of each emitted light with the plurality of optical distance sensors.

Methods can include one or more of the following features.

In some implementations, the method includes encoding the measured time of arrival, incidence angle, and/or intensity into a signal.

In some implementations, the method includes transmitting the signal via the transmitter to a computer.

In some implementations, the transmitter includes an electric-acoustic transducer.

In some implementations, emitting light includes emitting light perpendicular to the inner surface of the outer wall of the housing.

In some implementations, emitting light includes emitting light at an angle relative to the inner surface of the outer wall of the housing.

In some implementations, a first optical distance sensor emits light and a second optical distance sensor measures the intensity and angle of incidence of the emitted light.

In some implementations, multiple optical distance sensors other than the first optical distance sensor measure the intensity and angle of incidence of the emitted light.

In some implementations, emitting light includes the plurality of optical distance sensors emitting lights simultaneously.

In some implementations, deploying the system in the well includes placing the system around a piece of tubing as the tubing is being installed in the well.

In an aspect, a system for monitoring a casing within a well includes tubing with an outer surface, a housing having an inner wall, an outer wall, and two end walls extending between the inner wall and the outer wall to define an annular enclosure, the housing extending around at least a portion of the tubing with an outer surface of the inner wall in contact with the outer surface of the tubing, a cylinder including an elastomer, the cylinder extending outward from an outer surface of the outer wall of the housing, the cylinder sized to contact an inner surface of the casing during use, a plurality of optical distance sensors, associated electronics, and a battery positioned inside the housing, a plurality of light sources positioned within the housing, each light source operable to emit light towards an optical distance sensor, and a transmitter.

Metal loss and deformations can compromise the structural integrity of completions, which can lead to well failure. Casing deformation may occur over periods of time ranging from months to weeks. For example, casing deformation can occur from compaction due to depletion of an over-pressured reservoir which is under-compacted. Reservoir depletion, in such cases, causes sustained casing pressure that can in turn cause casing deformation or failure. Sustained casing pressure can also cause cement sealing failure due to micro fractures or cracks, which can produce safety consequences.

Monitoring for casing deformation can be difficult. These methods and systems can increase accuracy and reduce blind spots in measurements relative to other systems, and they can also reduce amount of time required for processing and analysis.

Advantageously, this disclosure describes methods and systems for continuously monitoring for casing deformations and pressures. In an embodiment, a system is placed in the well to perform continuous monitoring of the casing. Continuously monitoring the casing can be advantageous because casings can deform rapidly.

This disclosure describes methods and systems for continuously monitoring for casing deformations and pressures. The disclosure is presented to enable any person skilled in the art to make and use the disclosed subject matter in the context of one or more particular implementations. Various modifications to the disclosed implementations will be readily apparent to those skilled in the art, and the general principles defined in this application may be applied to other implementations and applications without departing from scope of the disclosure. Thus, the present disclosure is not intended to be limited to the described or illustrated implementations, but is to be accorded the widest scope consistent with the principles and features disclosed in this application.

The details of one or more embodiments of these systems and methods are set forth in the accompanying drawings and description below. Other features, objects, and advantages of these systems and methods will be apparent from the description, drawings, and claims.

DETAILED DESCRIPTION

Figure 1A:
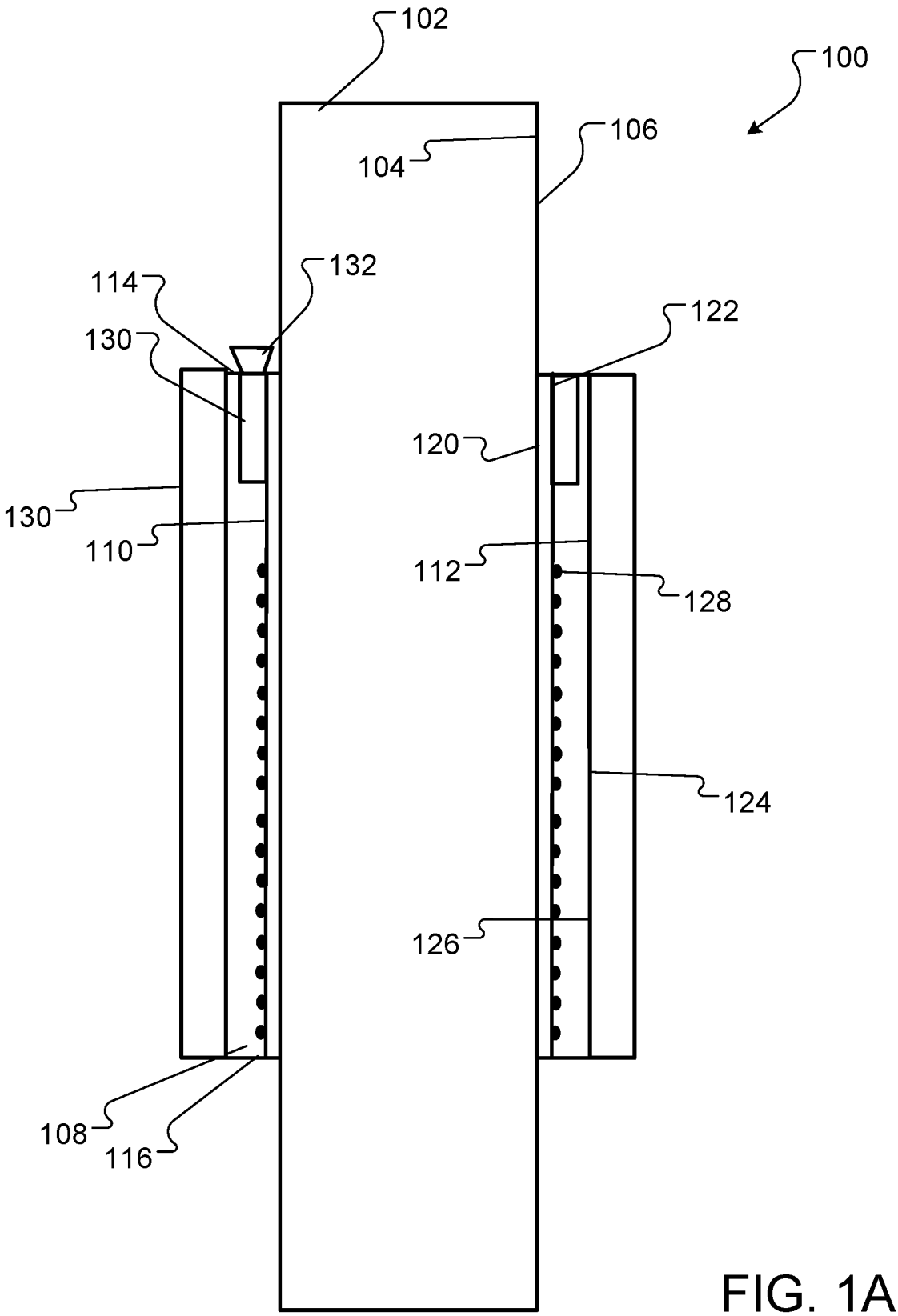
FIG. 1A illustrates a well packer system for monitoring casing deformations.

FIG. 1A illustrates a system 100 for continuously monitoring for casing deformations. The system 100 includes tubing 102 for containing a fluid. The tubing 102 has an inner surface 104 and an outer surface 106. A housing 108 extends around at least a portion of the tubing 102. The housing 108 has an inner wall 110, an outer wall 112, and two end walls 114, 116 extending between the inner wall 110 and the outer wall 112. The inner wall 110, outer wall 112, and two end walls 114, 116 define an annular enclosure 118. The inner wall 110 has an outer surface 120, which is external to the enclosure 118, and an inner surface 122, which is internal to the enclosure 118. The outer surface 120 of the inner wall 110 is in contact with the outer surface 106 of the tubing 102. The outer wall 112 also has an outer surface 124, which is external to the enclosure 118, and an inner surface 126, which is internal to the enclosure 118.

Inside the enclosure, a plurality of optical distance sensors 128 are attached to the inner surface 122 of the inner wall 110 of the housing. Each of the optical sensors 128 are operable to emit light towards the inner surface 126 of the outer wall 112 of the housing 108. For example, each optical sensor 128 can include a laser which is operable to emit light towards the inner surface 126 of the outer wall 112 of the housing 108.

The plurality of optical distance sensors 128 can be organized in arrays along the length of the inner surface 122 of the inner wall 110. In some implementations, the optical distance sensors can be distributed at equidistant polar angles around the inner surface 122 of the inner wall 110. For example, four optical distance sensors 128 can be distributed at 90 degrees of azimuthal separation around the inner surface 122 of the inner wall 110. In other implementations, more or fewer optical distance sensors 128 can be distributed around the inner surface 122 of the inner wall 110. In some implementations, the optical distance sensors are not distributed at equidistant polar angles. For example, four optical distance sensors can be distributed at angles other than 90 degrees of azimuthal separation around the inner surface of the inner wall.

In some implementations, the optical distance sensors are located elsewhere in the enclosure. For example, in some implementations, the optical distance sensors are organized on the inner surface 126 of the outer wall 112 of the housing. In some implementations, the optical distance sensors can be placed along the end walls 114, 116. In some implementations, light sources which are separate from the optical distance sensors emit light towards the optical distance sensors. For example, a laser array can be mounted to the inner surface 126 of the outer wall 112 of the housing and can emit light towards the optical distance sensors 128 on the inner surface 122 of the inner wall 110.

Multiple optical distance sensors can also be distributed along the length of the inner surface 122 of the inner wall 110. For example, in the illustrated implementation, 16 optical distance sensors are distributed along the length of the inner surface 122 of the inner wall. In other implementations, more or fewer optical distance sensors can be distributed along the length of the inner surface 122 of the inner wall. In some implementations, the optical distance sensors are distributed equidistantly along the length of the inner surface of the inner wall. In other implementations, the optical distance sensors are not distributed equidistantly.

The enclosure also contains electronics and a battery 130 to power the optical sensors 128. The electronics can include electronics which are associated with the optical sensors 128, such as transducers, light sources, cooling systems, microprocessors, transceivers, etc. The electronics encode data, such as the time of arrival and the incidence angle, of a light received at an optical distance sensor 128. The data can is transmitted to an external device, such as a computer or smartphone, via a transmitter 132. The transmitter 132 can be an electric-acoustic transducer which transmits the data to the external device via an acoustic signal. The transmitter 132 can also transmit the data in other forms, such as through a Bluetooth or internet connection.

The system 100 also includes a cylinder 130 extending outward from the outer surface 124 of the outer wall 112 of the housing 108. The cylinder 130 can be formed, for example, of an elastomer. In some implementations, the cylinder 130 can be formed of a flexible thermoplastic or a shape memory polymer with low thermal expansion (<0.01 mm/K) and low thermal conductivity (0.03-0.1 W/mK). Shape memory polymers can return to their original shape using an electrical signal, thus enabling a quick release for retrieval operations and in-situ recalibration. The cylinder is sized to contact an inner surface of the casing which is to be monitored. The cylinder 130 has material properties such that deformation of the casing which is to be monitored will be reflected by deformation in the cylinder 130 and in the inner surface 126 of the outer wall 112 of the housing 108. The deformation can be detected by one of the optical distance sensors 128. For example, a change in captured data from at least one of the optical distance sensors 128 can be indicative of a deformation.

Figure 1B:
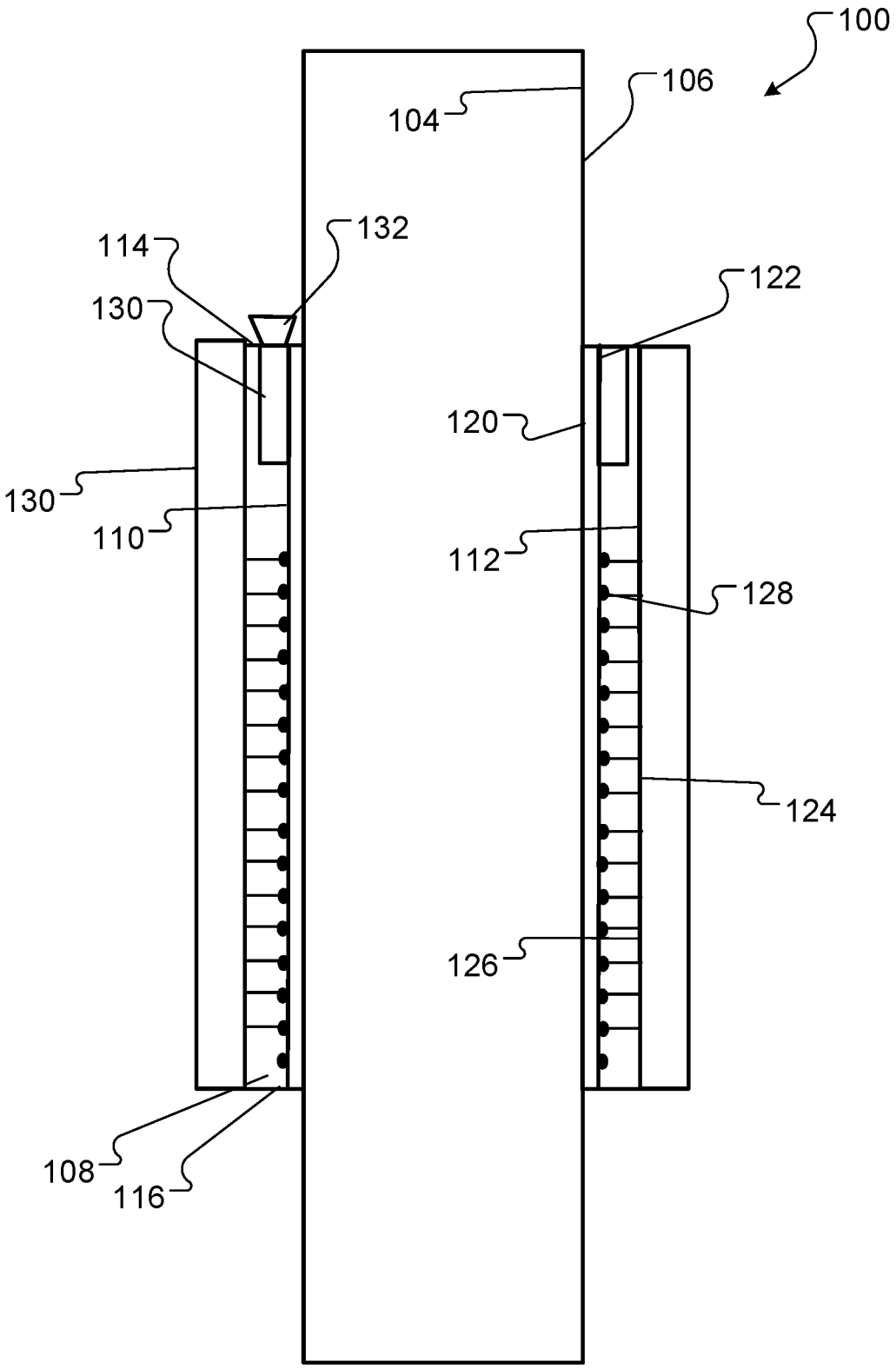
FIG. 1B illustrates the well packer system of FIG. 1A emitting light in a first operation to monitor for casing deformations.

FIG. 1B illustrates operation of the system 100. In the illustrated operation, the optical sensors 128 emit light perpendicular to the inner surface 126 of the outer wall 112 of the housing 108. Each emitted light is reflected perpendicular back to the same optical sensor 128 from which the light was emitted. This operation is advantageous because none of the lights cross or overlap, which reduces errors in the captured data from interference. If the inner surface 126 of the outer wall 112 were to deform, then the lights may not be reflected back to the same optical sensor 128 from which the light was emitted. This change would be represented in the transmitted data, and a user could recognize a deformation in the casing.

The lights are illustrated as red, but in other embodiments the lights can be other colors, such as green or yellow. Green or yellow lights can be advantageous because they require less power than red lights.

In some systems, all of the optical sensors 128 emit a light, each with a distinct frequency, simultaneously. All of the optical sensors 128 then capture the emitted lights. Because each light has a distinct frequency, the source of each captured light can be determined. Deformations in the casing can be identified by a change in the captured data.

In some operations, different optical sensors 128 emit light at different times. For example, the optical sensors 128 can emit light sequentially from one end of the inner wall 110 to the other end of the inner wall 110. The optical sensors 128 can also emit light in other patterns.

In other operations of the system 100, different optical sensors 128 can emit light and different optical sensors 128 can capture the emitted light. Different combinations of optical sensors emitting light and optical sensors capturing light can be implemented according to desired operations.

Figure 2:
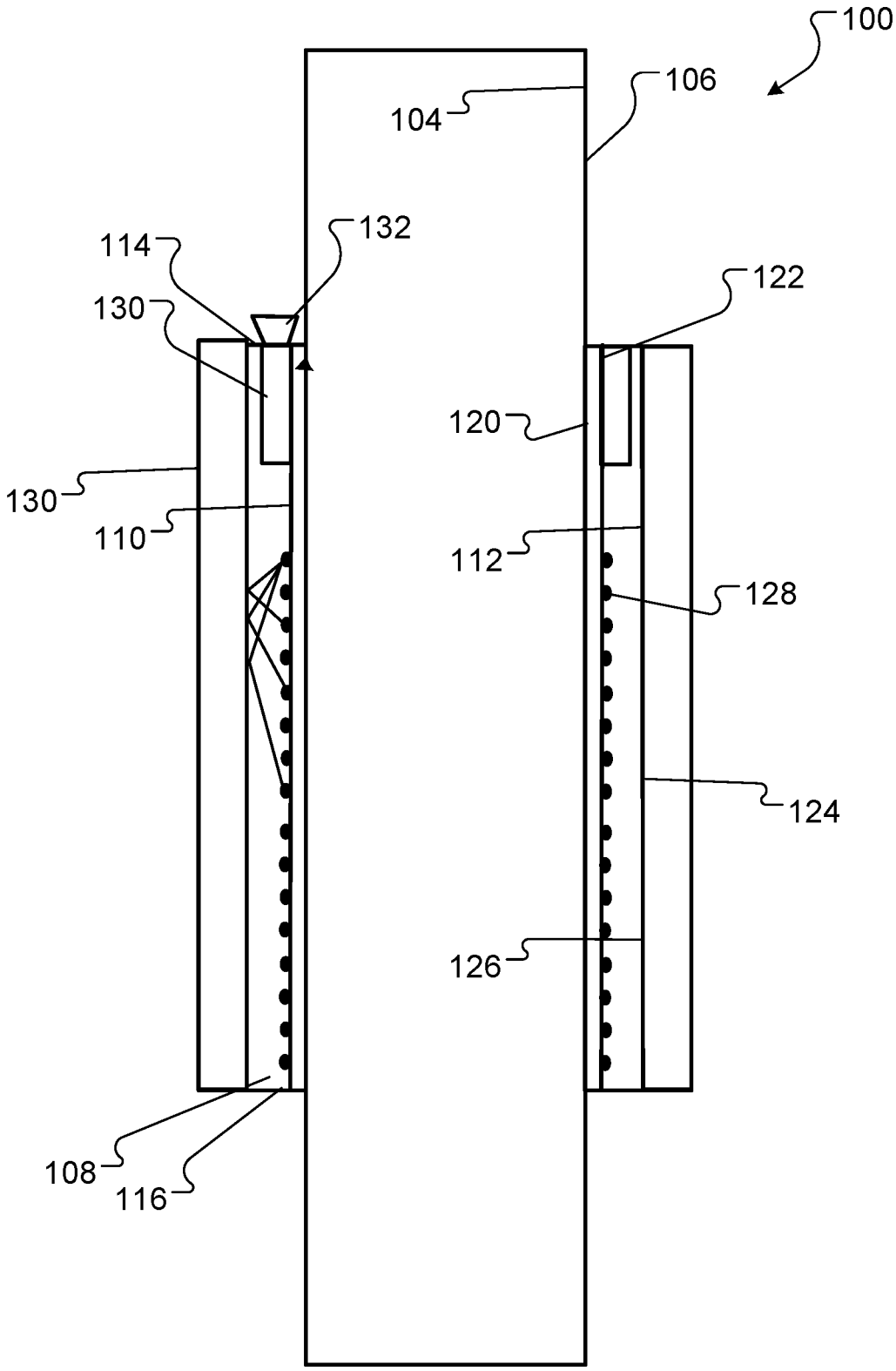
FIG. 2 illustrates the well packer system of FIG. 1A emitting light in a second operation to monitor for casing deformations.

FIG. 2 illustrates another system 150. In the system 150, the optical sensors do not emit light perpendicular to the inner surface 126 of the outer wall 112 of the housing 108. Instead, the optical sensors emit light at an angle relative to the inner surface 126 of the outer wall 112 of the housing 108. For example, an optical sensor 128*a* emits light, which reflects off the inner surface 126 of the outer wall 112 of the housing 108 and is captured by a number of different optical sensors 128*b*, 128*c*, 128*d*. In some embodiments, each of the optical sensors aligned with the optical sensor 128*a* (i.e., each of the optical sensors at the same polar angle around the inner surface 122 of the inner wall 110) can capture light which is emitted by the optical sensor 128*a*. This is advantageous because arrival times of the captured light at different sensors indicates possible directions of deformation.

Figure 3:
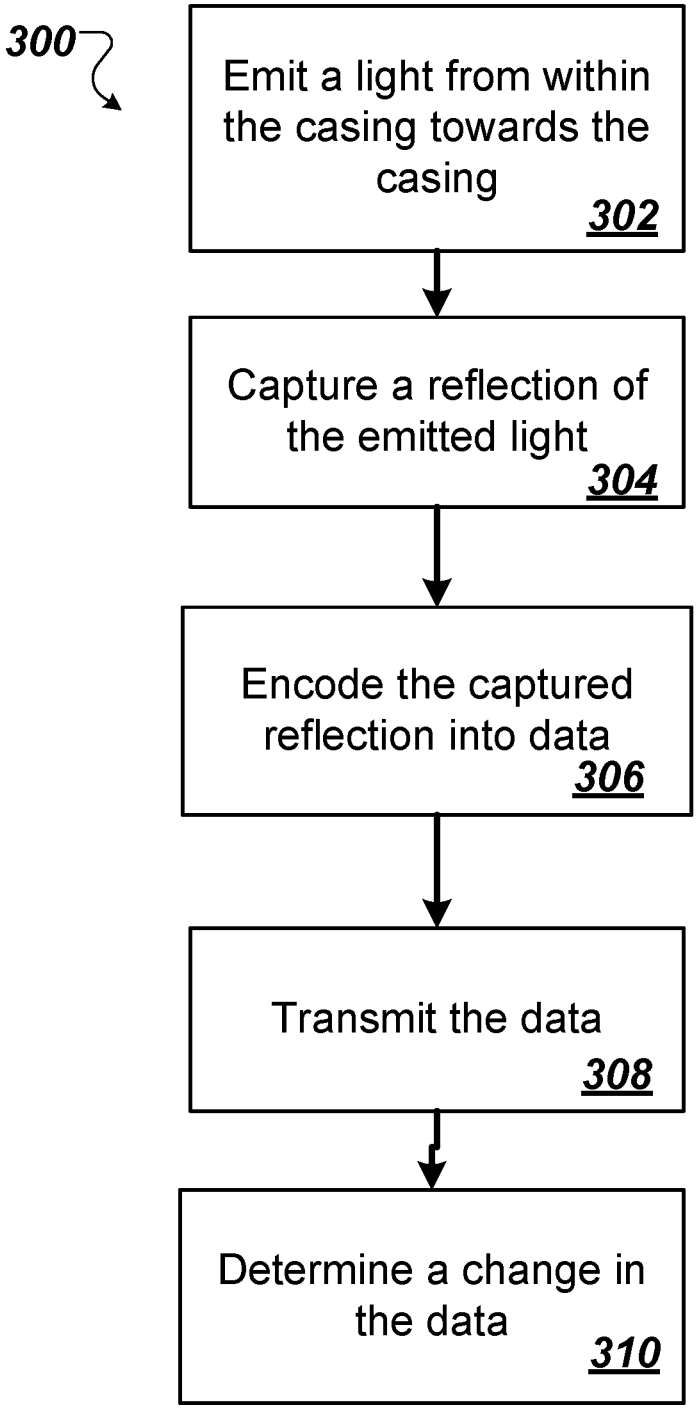
FIG. 3 is a flowchart of a method for monitoring casing deformations.

FIG. 3 is a flowchart of a method 300 for monitoring a tubing within a well. The method 300 begins with deploying a system in a well (302). For example, the packer can be similar to the system 100 of FIGS. 1A and 1B. For example, the system can include a housing having an inner wall, an outer wall, and two end walls extending between the inner wall and the outer wall to define an annular enclosure, the housing extending around at least a portion of the tubing with an outer surface of the inner wall in contact with the outer surface of the tubing, a cylinder comprising an elastomer, the cylinder extending outward from an outer surface of the outer wall of the housing, the cylinder sized to contact an inner surface of the casing during use, a plurality of optical distance sensors, associated electronics, and a battery positioned inside the housing, each optical distance sensor comprise at one laser operable to emit light towards an inner surface of the outer wall of the housing, and a transmitter. After a wellbore is drilled, the system can be deployed by being placed around a section of tubing. In some implementations, the system can be placed as the tubing is being installed. In other implementations, the system can be placed after the tubing is installed.

While the system is monitoring the casing, light is emitted towards the inner surface of the outer wall of the housing of the deployed system. As discussed above, emitting light can include emitting light from a number of lasers. The light can be emitted perpendicular to the inner surface of the outer wall of the housing and/or at an angle relative to the inner surface of the outer wall of the housing. In some embodiments, multiple optical distance sensors emit light simultaneously.

Data associated with the emitted light is measured downhole (304). In some implementations, the data is measured periodically (e.g., hourly, daily, or weekly). In some cases, measuring the data periodically is advantageous and conserves power. In other implementations, the data is measured continuously. In some cases, measuring the data continuously is advantageous and captures rapid deformations in the casing. Data associated with the emitted light can include the time of arrival, incidence angle, and/or intensity of each emitted light. The data can be measured, for example, with the plurality of optical distance sensors included in the packer. An optical distance sensor can measure the data of its own emitted light, or an optical sensor can measure the data of a light emitted by a different optical distance sensor.

The data associated with the emitted light is encoded (306). For example, this can include encoding the measured time of arrival, incidence angle, and/or intensity into a signal, such as an electric signal or an acoustic signal. In some implementations, the data is encoded downhole. For example, the deployed system can include a processor which can encode the data received by the optical distance sensors. In other implementations, the data is encoded at the surface. For example, a computing system located on the surface can encode the data.

The data associated with the emitted light is transmitted as a signal (308). For example, transmitting the signal can include transmitting the signal to the surface via a transmitter of the deployed packer. The transmitter can be an electric-acoustic transducer or other type of transmitter. For example, the system transmits data to an external device, such as a computer or smartphone, via a transmitter.

Changes in the data are determined (310). For example, a change in the data can represent a change in the distance between an optical sensor and the surface being monitored, which can be indicative of a casing deformation.

Figure 4:
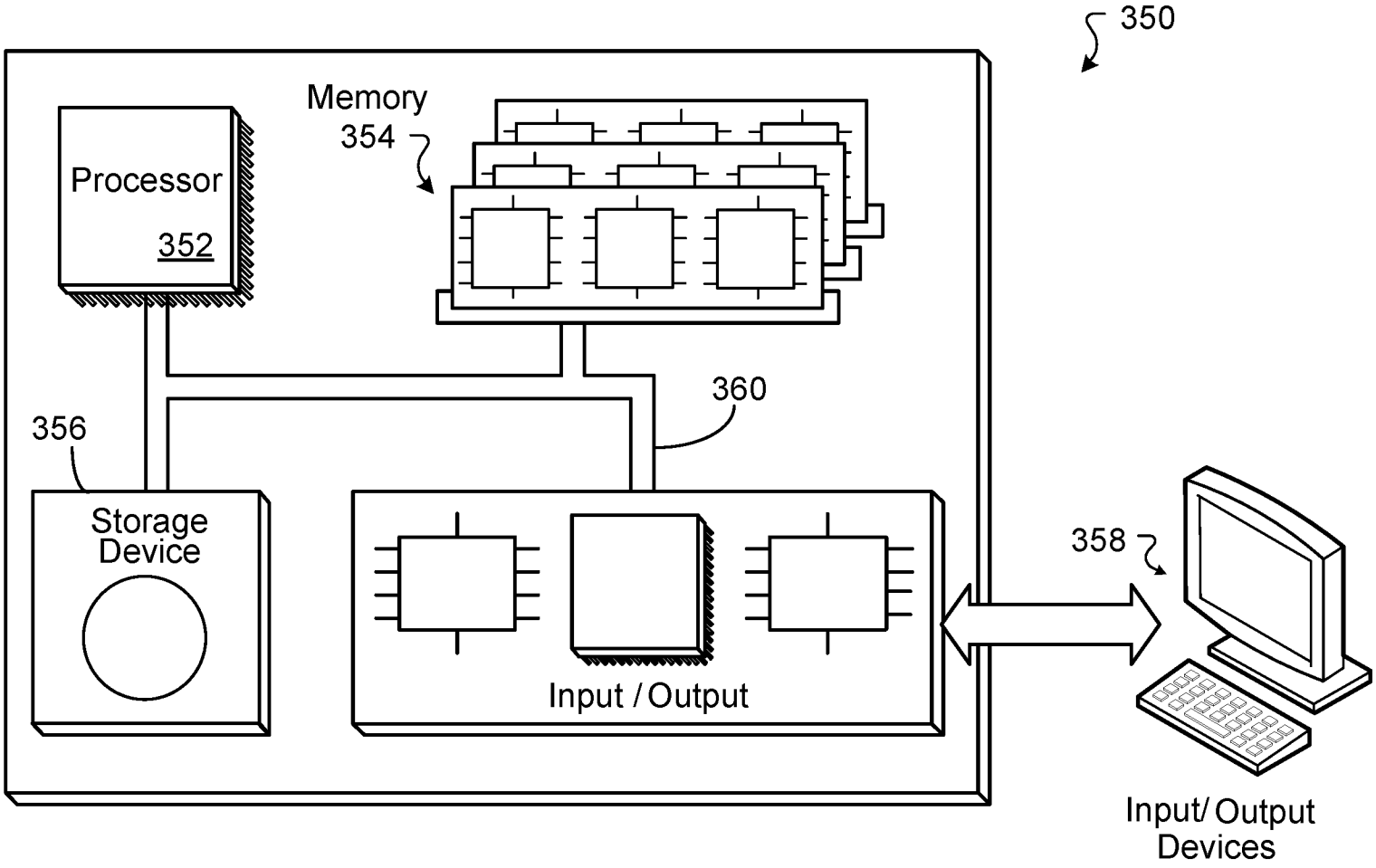
FIG. 4 is a schematic illustration of an example computer.

FIG. 4 is a schematic illustration of an example computer 350 of the gas operation network. For example, the computer 350 includes the computer 134 and/or the control system 104 for controlling the microcapsule formation system 100.

The computer 350 is intended to include various forms of digital computers, such as printed circuit boards (PCB), processors, digital circuitry, or otherwise parts of a system for determining a subterranean formation breakdown pressure. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The computer 350 includes a processor 352, a memory 354, a storage device 356, and an input/output device 358 (for displays, input devices, example, sensors, valves, pumps). Each of the components 352, 354, 356, and 358 are interconnected using a system bus 360. The processor 352 is capable of processing instructions for execution within the computer 350. The processor may be designed using any of a number of architectures. For example, the processor 352 may be a CISC (Complex Instruction Set Computers) processor, a RISC (Reduced Instruction Set Computer) processor, or a MISC (Minimal Instruction Set Computer) processor.

In one implementation, the processor 352 is a single-threaded processor. In another implementation, the processor 352 is a multi-threaded processor. The processor 352 is capable of processing instructions stored in the memory 354 or on the storage device 356 to display graphical information for a user interface on the input/output device 358.

The memory 354 stores information within the computer 350. In one implementation, the memory 354 is a computer-readable medium. In one implementation, the memory 354 is a volatile memory unit. In another implementation, the memory 354 is a non-volatile memory unit.

The storage device 356 is capable of providing mass storage for the computer 350. In one implementation, the storage device 356 is a computer-readable medium. In various different implementations, the storage device 356 may be a floppy disk device, a hard disk device, an optical disk device, or a tape device.

The input/output device 358 provides input/output operations for the computer 350. In one implementation, the input/output device 358 includes a keyboard and/or pointing device. In another implementation, the input/output device 358 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Accordingly, the previously described example implementations do not define or constrain the present disclosure. Other changes, substitutions, and alterations are also possible without departing from the spirit and scope of the present disclosure.

What is claimed is:

1. A system for monitoring a casing within a well, the system comprising:

tubing with an outer surface;

a housing having an inner wall, an outer wall, and two end walls extending between the inner wall and the outer wall to define an annular enclosure, the housing extending around at least a portion of the tubing with an outer surface of the inner wall in contact with the outer surface of the tubing;

a cylinder comprising an elastomer, the cylinder extending outward from an outer surface of the outer wall of the housing, the cylinder sized to contact an inner surface of the casing during use;

a plurality of optical distance sensors, associated electronics, and a battery positioned inside the housing, each optical distance sensor being organized along the inner wall of the housing and comprising a laser operable to emit light towards an inner surface of the outer wall of the housing, wherein a laser of one of the plurality of optical sensors is operable to emit light at an angle relative to the inner surface of the outer wall of the housing internal to the annular enclosure, and other optical distance sensors of the plurality of optical sensors measure an intensity and angle of incidence of light reflected off the inner surface of the outer wall of the housing internal to the annular enclosure, the plurality of optical distance sensors comprising four optical distance sensors distributed around the inner wall of the housing at 90 degrees of azimuthal separation, the plurality of optical distance sensors comprising a plurality of aligned optical distance sensors distributed equidistantly along a length of the inner wall of the housing, wherein each laser of the plurality of optical distance sensors emits light simultaneously, wherein each emitted light has a distinct frequency, wherein a first optical distance sensor is configured to emit light which reflects off the inner surface of the outer wall of the housing such that the reflected light is captured by each of the optical distance sensors at a same polar angle around the inner surface of the inner wall as the first optical distance sensor;

a transmitter configured to transmit signals associated with the intensity and the angle of incidence of the reflected light; and a computing device comprising:

a memory configured to store instructions; and a processor configured to execute the instructions to perform operations comprising:

receiving the signals from the transmitter;

detecting a change in data captured by at least one of the optical distance sensors over time, wherein the change in data represents a change in a distance between an optical distance sensor of the plurality of optical distance sensors and an inner surface of the outer wall of the housing.

2. The system of claim 1, wherein the associated electronics are configured to encode the time of arrival and incidence angle of an emitted light received at an optical distance sensor of the array of optical distance sensors into data and send the data via the transmitter to a computer.

3. The system of claim 1, wherein the lasers are low power lasers.

4. The system of claim 3, wherein the lasers are green or yellow lasers.

5. The system of claim 1, wherein the transmitter comprises an electric-acoustic transducer.

6. The system of claim 1, wherein each of the multiple optical distance sensors is configured to receive the emitted light at different times.

7. A method for monitoring tubing within a well, the method comprising:

deploying a system in a well, the system having a housing having an inner wall, an outer wall, and two end walls extending between the inner wall and the outer wall to define an annular enclosure, the housing extending around at least a portion of the tubing with an outer surface of the inner wall in contact with the outer surface of the tubing, a cylinder comprising an elastomer, the cylinder extending outward from an outer surface of the outer wall of the housing, the cylinder sized to contact an inner surface of the casing during use, a plurality of optical distance sensors, associated electronics, and a battery positioned inside the housing, each optical distance sensor comprising at one laser operable to emit light towards an inner surface of the outer wall of the housing, the plurality of optical distance sensors being organized along the inner wall of the housing, the plurality of optical distance sensors comprising four optical distance sensors distributed around the inner wall of the housing at 90 degrees of azimuthal separation, the plurality of optical distance sensors comprising a plurality of aligned optical distance sensors distributed equidistantly along a length of the inner wall of the housing, the system comprising a transmitter;

emitting light from the plurality of optical distance sensors at an angle relative to the inner surface of the outer wall of the housing internal to the annular enclosure, wherein each laser emits light simultaneously, wherein each emitted light has a distinct frequency;

measuring the time of arrival, incidence angle, and/or intensity of each emitted light reflected off the inner surface of the outer wall of the housing internal to the annular enclosure with the plurality of optical distance sensors, wherein for a first optical distance sensor of the plurality of optical distance sensors, each of the optical distance sensors at a same polar angle around the inner surface of the inner wall as the first optical distance sensor captures light emitted from the first optical distance sensor; and detecting a change in data captured by at least one of the optical distance sensors over time, wherein the change in data represents a change in a distance between an optical distance sensor of the plurality of optical distance sensors and an inner surface of the outer wall of the housing.

8. The method of claim 7, further comprising encoding the measured time of arrival, incidence angle, and/or intensity into a signal.

9. The method of claim 7, further comprising transmitting the signal via the transmitter to a computer.

10. The method of claim 7, wherein the transmitter comprises an electric-acoustic transducer.

11. The method of claim 7, wherein deploying the system in the well comprises placing the system around a piece of tubing as the tubing is being installed in the well.

12. A system for monitoring a casing within a well, the system comprising:

tubing with an outer surface;

a housing having an inner wall, an outer wall, and two end walls extending between the inner wall and the outer wall to define an annular enclosure, the housing extending around at least a portion of the tubing with an outer surface of the inner wall in contact with the outer surface of the tubing;

a cylinder comprising an elastomer, the cylinder extending outward from an outer surface of the outer wall of the housing, the cylinder sized to contact an inner surface of the casing during use;

a plurality of optical distance sensors, associated electronics, and a battery positioned inside the housing, a plurality of light sources organized along the inner wall of the housing, each light source operable to emit light towards an optical distance sensor, wherein a laser of one of the plurality of optical sensors is operable to emit light at an angle relative to the inner surface of the outer wall of the housing internal to the annular enclosure, and other optical distance sensors of the plurality of optical sensors measure an intensity and angle of incidence of light reflected off the inner surface of the outer wall of the housing internal to the annular enclosure, the plurality of optical distance sensors comprising four optical distance sensors distributed around the inner wall of the housing at 90 degrees of azimuthal separation, the plurality of optical distance sensors comprising a plurality of aligned optical distance sensors distributed equidistantly along a length of the inner wall of the housing, wherein each laser of the plurality of optical distance sensors emits light simultaneously, wherein each emitted light has a distinct frequency, wherein a first optical distance sensor is configured to emit light which reflects off the inner surface of the outer wall of the housing such that the reflected light is captured by each of the optical distance sensors at a same polar angle around the inner surface of the inner wall as the first optical distance sensor;

a transmitter configured to transmit signals associated with the intensity and the angle of incidence of the reflected light; and a computing device comprising:

a memory configured to store instructions; and a processor configured to execute the instructions to perform operations comprising:

receiving the signals from the transmitter;

detecting a change in data captured by at least one of the optical distance sensors over time, wherein the change in data represents a change in a distance between an optical distance sensor of the plurality of optical distance sensors and an inner surface of the outer wall of the housing.

* * * * *